US009938686B2

(12) United States Patent
Mitola et al.

(10) Patent No.: US 9,938,686 B2
(45) Date of Patent: Apr. 10, 2018

(54) LOCAKABLE MANHOLE COVERS AND METHODS FOR LOCKING A MANHOLE COVER

(71) Applicant: Utility Designs of New York LLC, Saratoga Springs, NY (US)

(72) Inventors: Anthony F. Mitola, Saratoga Springs, NY (US); Lawrence E. Jordan, Amsterdam, NY (US); Michael O'Donnell, Valhalla, NY (US); Joseph Vainauskas, Amsterdam, NY (US)

(73) Assignee: Utility Designs of New York LLC, Saratoga Springs, NY (US)

( * ) Notice: Subject to any disclaimer, the term of this patent is extended or adjusted under 35 U.S.C. 154(b) by 0 days.

(21) Appl. No.: 15/424,553

(22) Filed: Feb. 3, 2017

(65) Prior Publication Data

US 2017/0226714 A1 Aug. 10, 2017

Related U.S. Application Data

(60) Provisional application No. 62/291,242, filed on Feb. 4, 2016.

(51) Int. Cl.

| | |
|---|---|
| ***E02D 29/14*** | (2006.01) |
| ***E05B 65/00*** | (2006.01) |
| ***E05C 5/04*** | (2006.01) |

(52) U.S. Cl.

CPC ..... *E02D 29/1427* (2013.01); *E02D 29/1481* (2013.01); *E05B 65/006* (2013.01); *E05C 5/04* (2013.01); *E02D 2300/0031* (2013.01)

(58) Field of Classification Search

CPC ..... E20D 29/1418; E20D 29/1427; E20D 29/1436

(Continued)

(56) References Cited

U.S. PATENT DOCUMENTS 1,988,360 A * 1/1935 Moore ..... F16J 13/08 220/327

2,114,499 A 4/1938 Maclear (Continued)

OTHER PUBLICATIONS

Mitola et al., U.S. Appl. No. 15/265,446, filed Sep. 14, 2016, entitled, Manhole Cover Locks, Lockable Manhole Covers, and Methods for Locking a Manhole Cover, 31-pages.

(Continued)

*Primary Examiner* — Thomas B Will
*Assistant Examiner* — Katherine J Chu
(74) *Attorney, Agent, or Firm* — Heslin Rothenberg Farley and Mesiti PC

(57) ABSTRACT

A lockable manhole cover includes, for example, a manhole cover installable in an opening in a manhole frame, a locking member attached via a pin and slot arrangement beneath the manhole cover, and a lever pivotally attached to the manhole cover. A lower end portion of the lever is operably engageable with the locking member to move the locking member relative to the manhole cover. The lever is disposable in a lowered position so that an end portion of the locking member is operably engageable with a portion of the manhole frame for use in inhibiting removal of the lockable manhole cover from the manhole frame. The lever is disposable in a raised position so that the end portion of the locking member is operably disengageable with the portion of the manhole frame to allow removal or installation of the lockable manhole cover from or in the manhole frame.

45 Claims, 12 Drawing Sheets

(58) Field of Classification Search
USPC ..... 404/25
See application file for complete search history.

(56) References Cited

U.S. PATENT DOCUMENTS

| | | | | |
|---|---|---|---|---|
| 2,323,886 | A * | 7/1943 | Wirz, Jr. | B66F 19/005 292/185 |
| 2,693,100 | A | 11/1954 | Wiegel | |
| 3,527,148 | A * | 9/1970 | Schack | E03F 5/06 404/25 |
| 3,888,528 | A * | 6/1975 | Jericijo | B63B 19/24 114/203 |
| 4,461,597 | A * | 7/1984 | Laurin | E02D 29/1427 137/371 |
| 4,739,896 | A * | 4/1988 | Moss | E02D 29/1427 220/324 |
| 4,750,569 | A * | 6/1988 | Flogaus | H05K 9/0062 174/375 |
| 4,854,076 | A * | 8/1989 | Sieben | B65D 90/10 49/280 |
| 4,928,615 | A * | 5/1990 | Williams | E05C 9/06 114/201 R |
| 5,533,641 | A * | 7/1996 | Argandona | B65D 90/105 220/248 |
| 6,021,606 | A * | 2/2000 | Kos | E02D 29/124 16/289 |
| 6,199,414 | B1 * | 3/2001 | Chang | E02D 29/1427 292/11 |
| 6,764,261 | B1 | 7/2004 | Stadler | |
| 6,811,119 | B1 * | 11/2004 | Petersen | E02D 29/1427 244/114 R |
| 7,144,189 | B1 | 12/2006 | Bongiovanni et al. | |
| 7,243,515 | B2 * | 7/2007 | Meyer | E02D 29/1427 404/25 |
| 7,484,908 | B2 | 2/2009 | Stadler | |
| 7,891,904 | B2 * | 2/2011 | Stadler | E02D 29/1427 404/25 |
| 7,896,574 | B2 | 3/2011 | Nolle et al. | |
| 8,888,400 | B2 * | 11/2014 | Nolle | E02D 29/1427 404/25 |
| 9,157,212 | B2 * | 10/2015 | Nolle | E02D 29/14 |
| 9,377,037 | B2 | 6/2016 | Daniels | |
| 9,416,516 | B2 | 8/2016 | Stadler | |
| 9,422,069 | B2 | 8/2016 | Valicek | |
| 2004/0069024 | A1 * | 4/2004 | Hauer | E02D 29/1427 70/167 |
| 2007/0223997 | A1 | 9/2007 | Fuchs et al. | |
| 2010/0028077 | A1 | 2/2010 | Stadler | |
| 2012/0054998 | A1 | 3/2012 | Tschida et al. | |
| 2013/0039716 | A1 | 2/2013 | McClure | |
| 2013/0221688 | A1 | 8/2013 | Stadler | |

OTHER PUBLICATIONS

Metcalf et al., "Design of Sewers", American Sewerage Practice, vol. 1, , 1st Edition, New York,1914, p. 559.

* cited by examiner

LOCAKABLE MANHOLE COVERS AND METHODS FOR LOCKING A MANHOLE COVER

CLAIM TO PRIORITY

This application claims the benefit of U.S. Provisional Application No. 62/291,242, filed Feb. 4, 2016 entitled "Manhole Cover Locks," which application is hereby incorporated herein in its entirety by reference.

FIELD OF THE DISCLOSURE

The present disclosure relates generally to manhole covers, and more particularly to lockable manhole covers and methods for locking a manhole cover.

BACKGROUND

Manhole covers made of cast iron make up the bulk of access covers in urban streets around the world. These covers have a proven record of durability, strength, and functionality. The high density of iron results in a cover of substantial weight preventing cover displacement during flooding conditions and minimizing the occurrence of theft.

Recently, gas or steam explosions below a street can cause manhole covers to become dangerous projectiles. For example, a cast iron manhole cover can weigh between 85 and 300 pounds, and explosions can propel the cover from 1 foot to 50 feet into the air. Often during various events particularly in large cities, utilities will temporary weld manhole covers to their frames to prevent access in and out of the manholes.

SUMMARY

Shortcomings of the prior art are overcome and additional advantages are provided through the provision, in one embodiment, of a lockable manhole cover for use with a manhole frame. The lockable manhole cover includes, for example, a manhole cover installable in an opening in the manhole frame, a locking member attached via a pin and slot arrangement beneath the manhole cover, and a lever pivotally attached to the manhole cover. The lever includes an upper end portion and a lower end portion, and the lower end portion is operably engageable with the locking member to move the locking member relative to the manhole cover. The lever is disposable in a lowered position relative to the manhole cover so that an end portion of the locking member is operably engageable with a portion of the manhole frame below the lockable manhole cover for use in inhibiting removal of the lockable manhole cover from the manhole frame. The lever is disposable in a raised position relative to the manhole cover so that the end portion of the locking member is operably disengageable with the portion of the manhole frame below the manhole cover to allow removal of the lockable manhole cover from the manhole frame or installation of the lockable manhole cover in the manhole frame.

In another embodiment, a method includes, for example, providing the above-noted lockable manhole cover with the lever in the raised position, positioning the lockable manhole cover on a rim of a manhole frame, and moving the lever to the lowered position.

In another embodiment, a method includes, for example, positioning a manhole cover disposed on a rim of a manhole frame, pivoting a lever about a fixed horizontal pivot axis relative to the manhole cover in a first direction and simultaneously moving a locking member about a pin and slot arrangement for operable engagement of the locking member with the manhole frame below the manhole cover for use in inhibiting removal of the manhole cover from the manhole frame, and pivoting the lever about the fixed horizontal pivot axis relative to the manhole cover in a second direction and simultaneously moving the locking member about the pin and slot arrangement for operable disengagement of the locking member with the manhole frame to allow removal of the manhole cover from the manhole frame.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

As described in greater detail below, the present disclosure provides lockable manhole covers and methods for use in locking or securing manhole covers to manhole frames. For example, the present disclosure may provide a single operation for unlocking and removing locked manhole covers from manhole frames. In a locked position, the lockable manhole covers may secure the manhole covers in place relative to manhole frames in the event of a gas or steam explosion.

Figure 1:
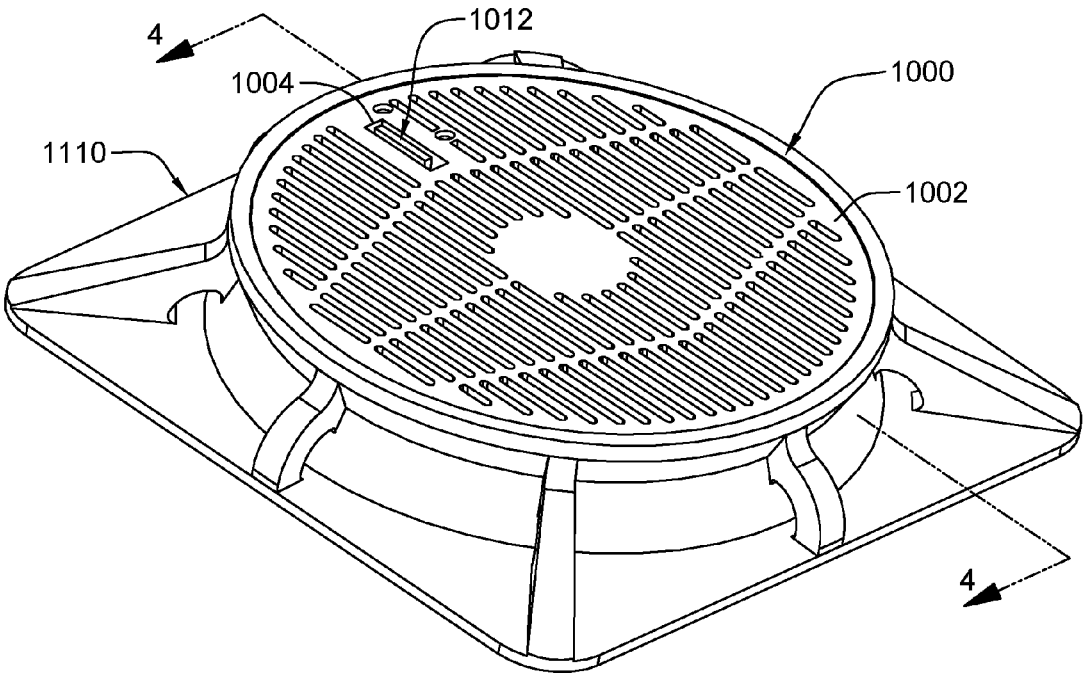
FIG. 1 is a perspective view of a lockable manhole cover and a manhole frame according to an embodiment of the present disclosure.

FIG. 1 illustrates an exemplary lockable manhole cover 1000 according to an embodiment of the present disclosure, which lockable manhole cover 1000 is releasably lockable to a manhole frame 1110. For example, exemplary lockable manhole cover 1000 may include a manhole cover 1002 and a locking assembly 1012 operable for use in locking manhole cover 1002 to manhole frame 1110. Locking assembly 1012 may be fitted or attached to manhole cover 1002 which manhole cover 1002 may be a new manhole cover or an existing manhole cover. For example, a portion of locking assembly 1012 may generally be diametrically arranged under manhole cover 1002, and a portion may be fitted to and extend from an aperture 1004 (FIG. 3) such as an opening that is cut into an existing manhole cover or an opening formed as part of a pattern of a new cast manhole cover. As will be appreciated from the description below, any cover, regardless of material or size, may be fitted with the locking assembly of the present disclosure.

Figure 2:
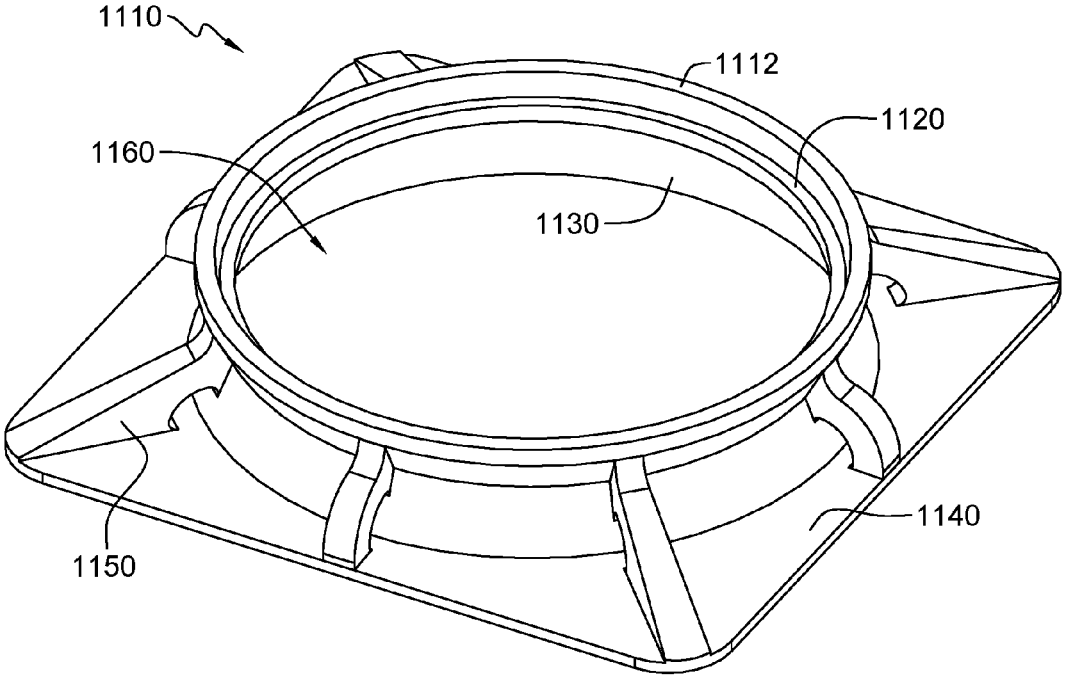
FIG. 2 is a perspective view of the manhole frame of FIG. 1.

With reference to FIG. 2, manhole frame 1110 may include an upper rim 1112, a lower smaller inset rim 1120 that supports manhole cover 1002 (FIG. 1), an angled sidewall 1130, a lower support 1140, and a plurality of gussets 1150. Manhole frame 1110 may define a circular opening 1160 therethrough. Manhole frame 1110 may be set flush with a paved surface such as a street, sidewalk, or parking lot as is known in the art. Manhole frame 1110 may be metal casting such as cast iron.

Figure 3:
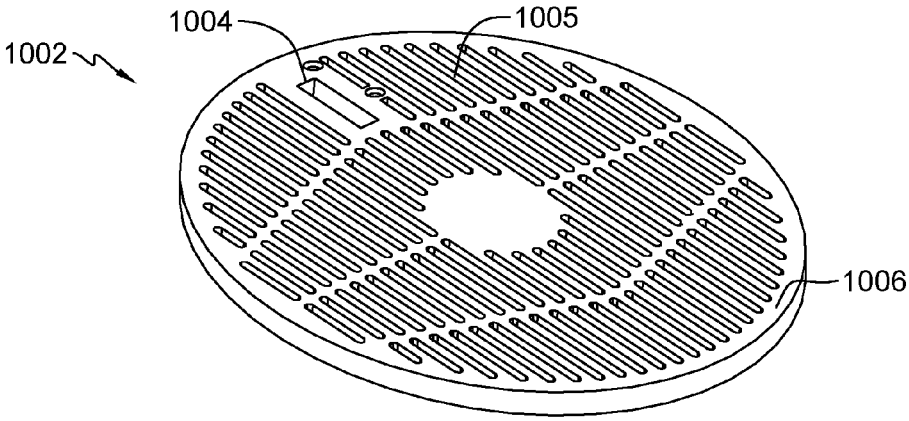
FIG. 3 is a perspective view of the manhole cover of FIG. 1.

As shown in FIG. 3, manhole cover 1002 may be an open grate cover having a plurality of elongated openings 1005. In other embodiments, a manhole cover may be a generally solid manhole cover. Manhole cover 1002 may include a peripheral edge portion 1006 sized to be received in rim 1112 (FIG. 2) and be supported on inset rim 1120 (FIG. 2) of manhole frame 1110 (FIG. 2). Manhole cover 1002 may include aperture 1004 adjacent to peripheral edge portion 1006. As described below, a portion of locking assembly 1012 (FIG. 1) may be selectively disposed in and extend from aperture 1004 as described in greater detail below. Manhole cover 1002 may be metal casting such as cast iron, or formed from a glass-reinforced plastic, other composite material, or other suitable material or combination thereof. While reference is made to the locking assemblies of the present disclosure being installed in a new manhole cover, it will be appreciated that the locking assemblies of the present disclosure may be installed and operable with existing manhole covers and manhole frames, e.g., retrofitted for use in existing manhole covers and manhole frames.

Figure 4:
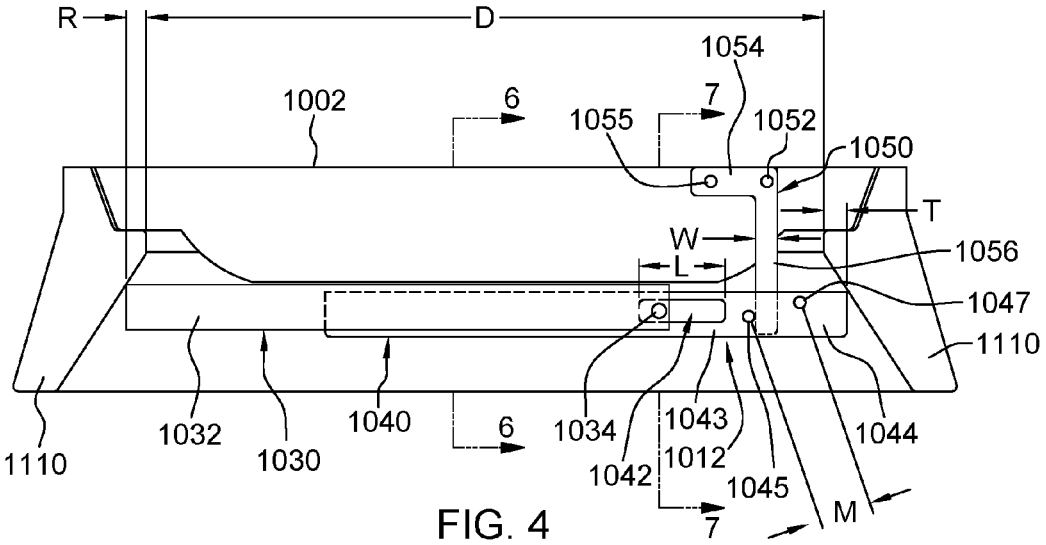
FIG. 4 is a cross-sectional view taken along line 4-4 in FIG. 1 illustrating the locking assembly disposed in a locked position with the manhole frame.
Figure 5:
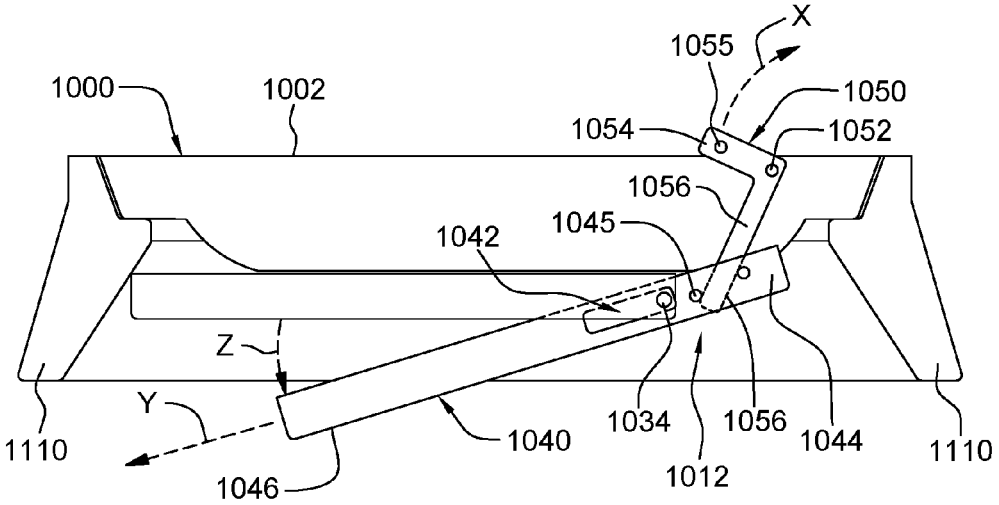
FIG. 5 is a cross-sectional view similar to FIG. 4 illustrating the locking assembly disposed in an unlockable position with the manhole frame.

FIG. 4 illustrates exemplary lockable manhole cover 1000 disposed in a first or lockable position or orientation with manhole frame 1110 in which lockable manhole cover 1000 may be used for inhibiting or preventing lockable manhole cover 1000 from being removed from manhole frame 1110. FIG. 5 illustrates exemplary lockable manhole cover 1000 disposed in a second or unlocked position or orientation relative to manhole frame 1110 in which lockable manhole cover 1000 may be removable from manhole frame 1110. As described below, exemplary locking assembly 1012 may provide a single operation for unlocking lockable manhole cover 1000 from manhole frame 1110. The single operation for unlocking may be readily followed by removal of lockable manhole cover 1000 from manhole frame 1110 as described below.

Figure 6:
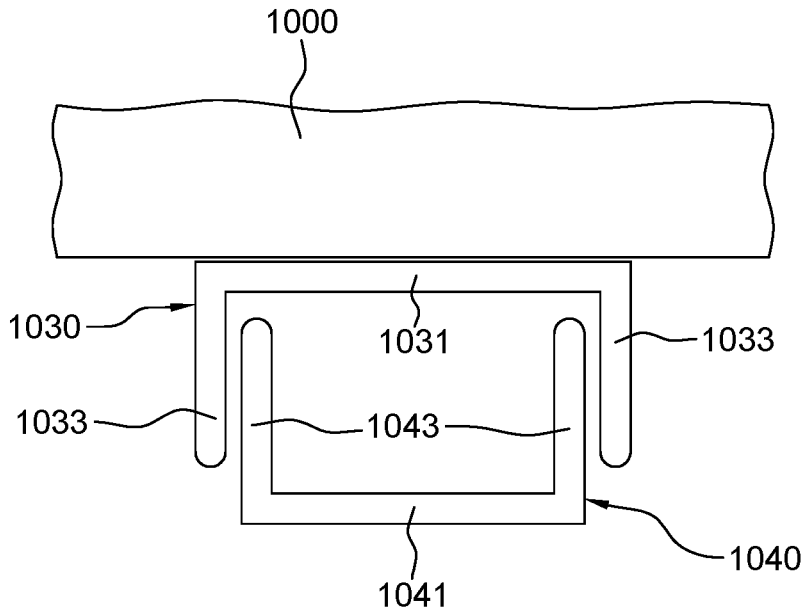
FIG. 6 is a cross-sectional view taken along line 6-6 in FIG. 4.

With reference again to FIG. 4, locking assembly 1012 may generally include a fixed arm or member 1030, a movable arm or locking member 1040, and a lever 1050. As shown in FIG. 6, fixed member 1030 may be an inverted C-shaped channel having a web 1031 and downwardly-depending legs 1033, and locking member 1040 may be an upright C-shaped channel having a web 1041 and upwardly-extending legs 1043 which upwardly-extending legs 1043 nest or fit in downwardly-depending legs 1033 of fixed member 1030. The fixed member may a C-shaped channel of about 6 inches wide and legs of about 2 inches long. The locking member may be a C-shaped channel of about 5 inches wide and legs of about 2 inches long. The C-shaped channels may be steel C-shaped channels.

With reference again to FIG. 4, fixed member 1030 may be fixedly attached such as by welding or being bolted to a bottom of manhole cover 1002 along the center or diameter of the manhole cover, or if a manhole cover is a casting, a fixed member be a cast-in feature. A first end portion 1032 of fixed member 1030 may extend radially outward a distance R greater than the innermost diameter D of manhole frame 1110 and be disposed below the innermost portion of manhole frame 1110.

Figure 7:
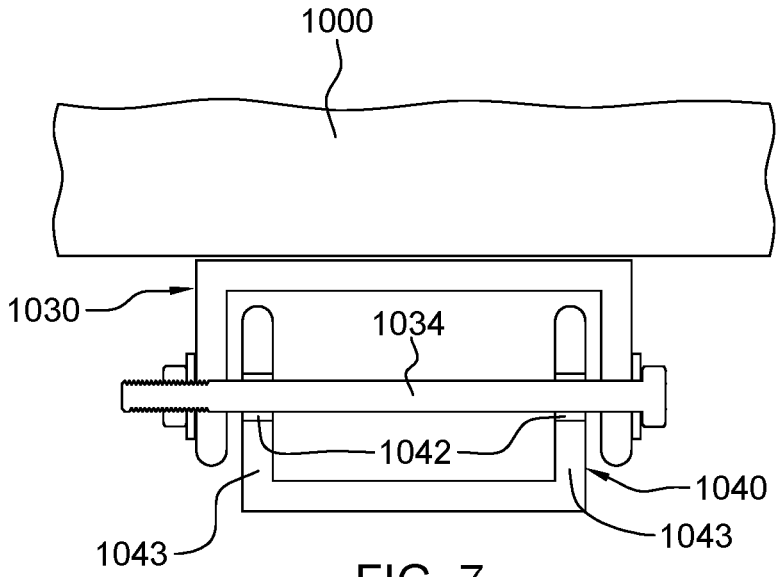
FIG. 7 is a cross-sectional view taken along line 7-7 in FIG. 4.

Locking member 1040 may be movably attached to fixed member 1030. For example, locking member 1040 may be movably attached to fixed member 1030 via a pin and slot arrangement. For example, locking member 1040 may be slidably and pivotably attached to fixed member 1030 via a pin or a bolt 1034 disposed in slots 1042 disposed in upwardly-extending legs 1043 as best shown in FIGS. 4 and 7. In this exemplary embodiment and as shown in FIG. 7, bolt 1034 may extend through and ride in slot 1042 in locking member 1040. A length L (FIG. 4) of slot 1042 limits and controls the axial or longitudinal movement of locking member 1040.

Figure 9:
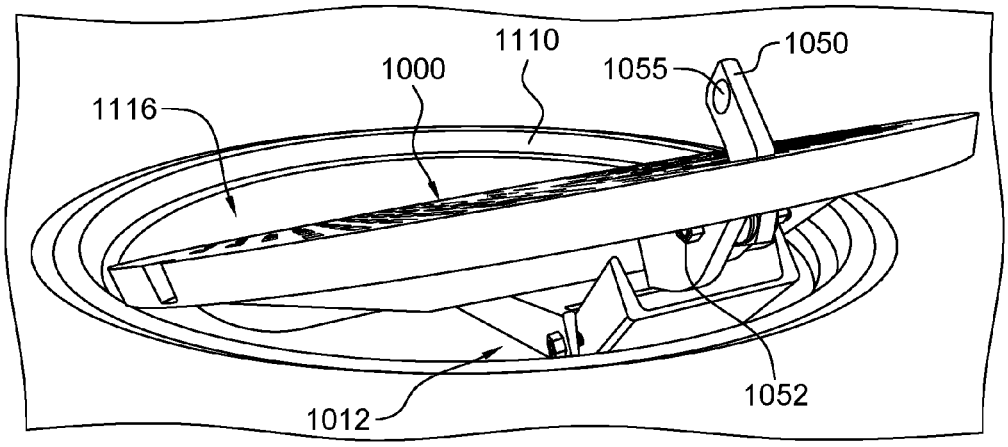
FIG. 9 is a perspective view of the lockable manhole cover of FIG. 8 illustrating the lockable manhole cover being removed from the manhole frame.
Figure 10:
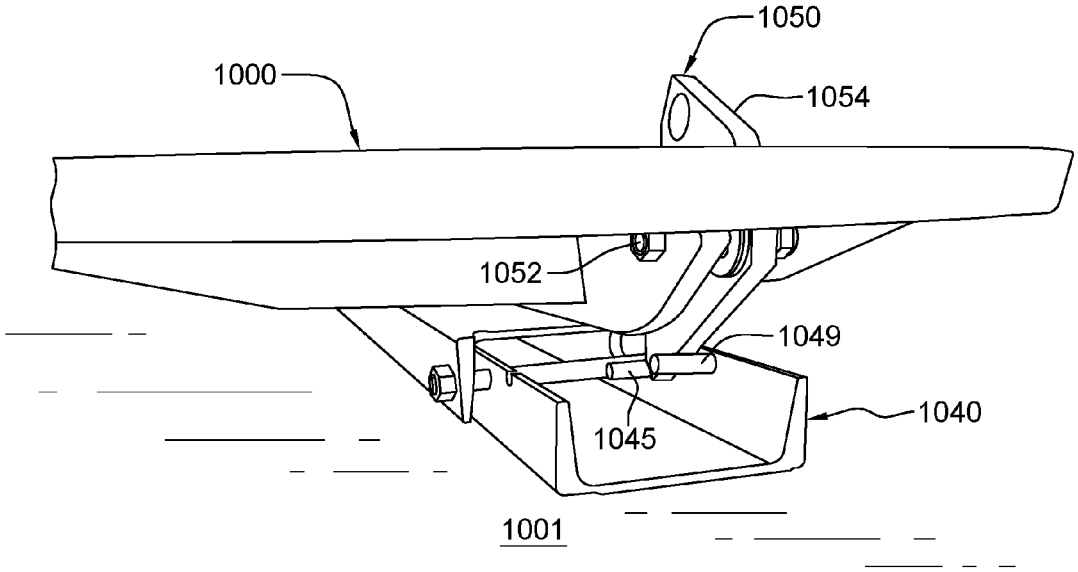
FIG. 10 is a perspective view of the lockable manhole cover of FIG. 9 illustrating the lockable manhole cover disposed on the ground such as a sidewalk or a street.

With reference again to FIGS. 4 and 5 (and as shown in FIGS. 9 and 10), lever 1050 may be an L-shaped member pivotally attached to manhole cover 1002 via a pin or bolt 1052. Lever 1050 may include a first leg 1054 and a second leg 1056, the intersection of which is pivotally attached and rotatable about bolt 1052. Leg 1054 may include an aperture 1055 such as a hole for receiving an end of a tool such as a hook-shaped tool used by utility personnel for removing lockable manhole cover 1000 from manhole frame 1110.

In the first lockable position as shown in FIG. 4, locking member 1040 is fully extended and an end portion 1044 of locking member 1040 may extend out a distance T greater than diameter D of manhole frame 1110, and in which in combination with first end portion 1032 of fixed member 1030 may be used for locking lockable manhole cover 1000 to manhole frame 1110. Second leg 1056 may act to cause locking member 1040 to be disposed in a horizontal orientation or position when lever 1050 is pushed down and disposed in a lowered position.

With locking member 1040 disposed in a horizontal orientation, attempts to remove lockable manhole cover 1000 from manhole frame 1110 may result in end portion 1044 of locking member 1040 frictionally engaging manhole frame 1110 which causes locking member 1040 to pivot clockwise about pin 1034 so that one or more upper portions, e.g., upper portions of the legs C-shaped channels, will be pressed against and engageable with portions of fixed member 1030 thereby preventing locking member 1040 from sliding inwardly.

Lever 1050 may have lower leg 1056 which extends downwardly and is disposed adjacent to or in contact with locking member 1040, e.g., inside of the web of the C-shaped channel, when lever 1050 is disposed in a lowered position and locking member 1040 is disposed in a horizontal orientation. Leg 1056 of lever 1050 may be square, rounded, or have any suitable configuration. It will be appreciated that a lever disposed in the lowered position may frictionally engage a locking member to aid in locking a lockable manhole cover to a frame.

With reference again to FIG. 5, unlocking lockable manhole cover 1000 may be initiated by moving lever 1050 such as rotating leg 1054 upwardly about bolt 1052 in the direction of curved arrow X. In the second or unlocked position as shown in FIG. 5, when locking member 1040 is retracted with end 1046 of locking member 1040 moving in an axial or longitudinal direction as shown by arrow Y and rotated in a direction of curved arrow Z about pin 1034, end portion 1044 of locking member 1040 moves inwardly and away from manhole frame 1110 so that locking member 1040 is disposed in a position that allows lockable manhole cover 1000 to be removed from manhole frame 1110.

Lockable manhole cover 1000 in transiting from the first lockable position to the second unlocked position, lever 1050 interacts with two pins or stops that are attached to locking member 1040. For example, when leg 1054 of lever 1050 is rotated upwardly and out of manhole cover 1002, leg 1056 of lever 1050 may interact with a first pin or stop 1045 of locking member 1040, which causes locking member 1040 to simultaneously move radially inward, slot 1042 sliding on pin 1034, and initiating rotation of locking member 1040.

Forcing or pushing leg 1054 of lever 1050 downwardly to the position shown in FIG. 4, causes leg 1056 to interact with a second pin or stop 1047. This interaction simultaneously rotates locking member 1040 to horizontal, and moves end portion 1044 of locking member 1040 radially outward to interfere with or be operably engageable with manhole frame 1110 so that locking assembly is disposed in the first horizontal position. First stop 1045 and second stop 1047 may be disposed at different elevations along locking member 1040. A distance M between first stop 1045 and second stop 1047 may be greater than a distance W across a lower end portion of leg 1056 of lever 1050. Distance M being greater than width W may provide clearance or a gap between the stops and the lower end portion of leg 1056 of lever 1050 so as to allow the rotation of both leg 1056 and locking member 1040 to occur.

With reference to FIGS. 4 and 5, the configurations and positions of one or more of the locking member 1040, slots 1042 in locking member 1040, bolt 1034, lever 1050, pin 1052, and stops 1045 and 1047, may be selected so that gravity may complete the action causing locking member 1040 to move to its fully retracted and rotated position (as shown in FIG. 5) once a utility worker begins to move leg 1054 upwardly. For example, as locking member 1040 retracts, gravity may act to rotate locking member 1040 and simultaneously slide it to its extreme retracted position (as shown in FIG. 5). In some embodiments, the weight of the locking member may be balanced or slightly offset depending on the relative locations slot 1042 and pin 1034.

The configurations and locations of one or more of the locking member 1040, slot 1042 in locking member 1040, pin 1034, lever 1050, pin 1052, and stops 1045 and 1047, may be selected so that in the first or lockable position as shown in FIG. 4, rotation of lever 1050 may be normally prevented upon movement of the manhole cover upwardly due to interaction of locking member 1040 with manhole frame 1110. For example, in some embodiments, a locking member may be balanced to remain in a horizontally normally locked position or orientation.

Figure 8:
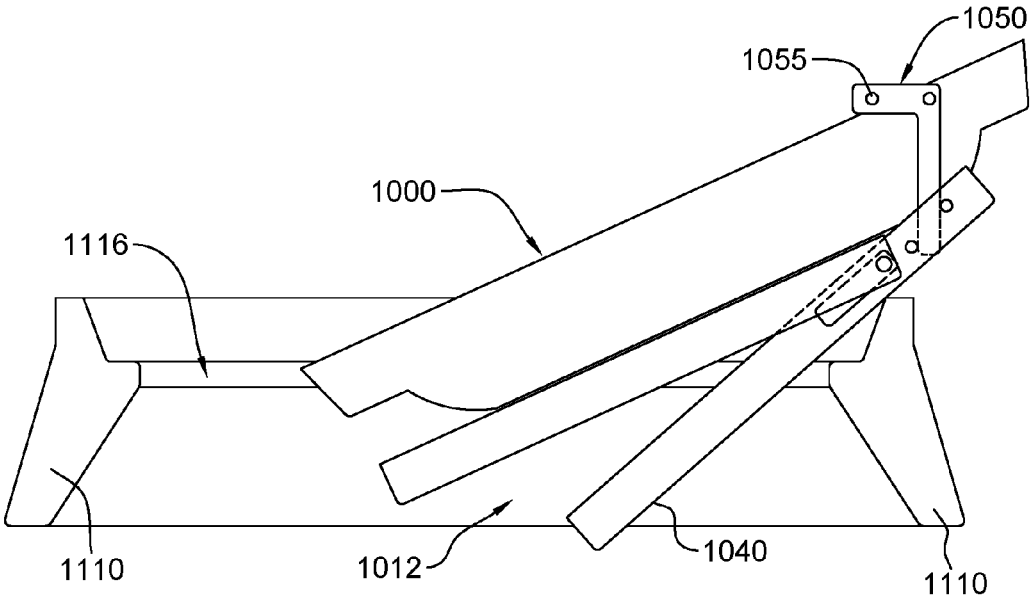
FIG. 8 is a cross-sectional view similar to FIG. 5 illustrating the lockable manhole cover being removed from the manhole frame.

With reference to FIGS. 8 and 9, in practice lockable manhole cover 1000 may be removed from opening 1116 in manhole frame 1110 with a hook tool commonly used by utility personnel. A utility worker using the tool may hook opening 1055 in lever 1050 and pull in the same fashion as if the manhole cover did not employ locking assembly 1012. The initial pull by the utility worker rotates lever 1050 causing the unlocking action described above. Further pulling on the hook tool attached to lever 1050 removes lockable manhole cover 1000 from opening 1116 of manhole frame 1110. The orientation of angled locking member 1040 in the unlocked position forms a type of ramp that may enhance the removability of lockable manhole cover 1000 from opening 1116 of manhole frame 1110, e.g., may reduce the force necessary to remove lockable manhole cover from the frame. Locking member 1040 may rotate back to horizontal as lockable manhole cover 1000 is remove completely from manhole frame 1110.

As shown in FIG. 10, once lockable manhole cover 1000 is completely out of an opening of a manhole frame and positioned on a street or a sidewalk 1001, locking member 1040 may be disposed in a horizontal orientation allowing lockable manhole cover 1000 to slide on the street sidewalk. With locking member 1040 remaining in this horizontal position, lockable manhole cover 1000 may be slid on the street or sidewalk back into opening 1116 of manhole frame 1110. Leg 1054 of lever 1050 may remain in a raised position. Lockable manhole cover 1000 once installed in a manhole frame, pressing leg 1054 of lever 1050 down flush with the surface of manhole cover 1002 initiates the locking action described above.

Figure 11:
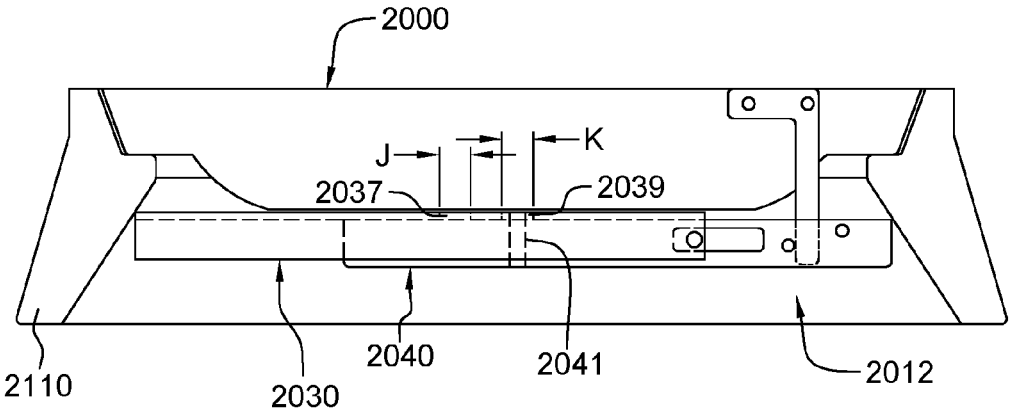
FIG. 11 is a cross-sectional view of a lockable manhole cover and a manhole frame according to an embodiment of the present disclosure illustrating a locking assembly disposed in a lockable position with a manhole frame.
Figure 12:
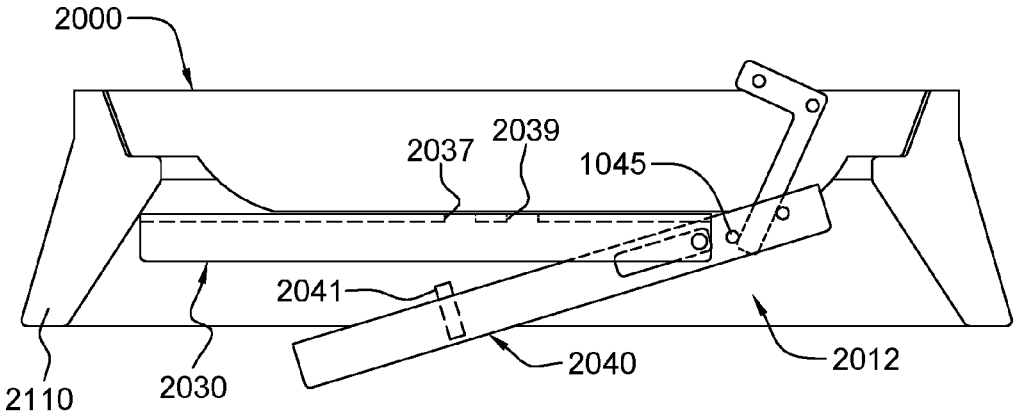
FIG. 12 is a cross-sectional view similar to FIG. 11 illustrating the locking assembly disposed in an unlocked position with the manhole frame.

FIGS. 11-14 illustrate a lockable manhole cover 2000 in accordance with an embodiment of the present disclosure, which lockable manhole cover 2000 may be releasably lockable to a manhole frame 2110 (FIGS. 11 and 12). For example, exemplary lockable manhole cover 2000 may be lockable to manhole frame 2110 (FIGS. 11 and 12) via a locking assembly 2012 in a similar manner as described above with reference to lockable manhole cover 1000 (FIG. 4) with the exception of securing lockable manhole cover 2000 in a locked position in a manhole frame and movable member 2040 securely disposed in a horizontal position when disposed on a sidewalk or street. Locking assembly 2012 may be fitted or attached to the manhole cover which manhole cover may be a new manhole cover or an existing manhole cover. For example, a portion of the locking assembly may extend and be fitted in an aperture such as an opening that is cut into an existing manhole cover or an opening formed as part of a pattern of a new cast manhole cover. As will be appreciated from the description below, any cover, regardless of material or size, may be fitted with the locking assembly of the present disclosure.

Figure 13:
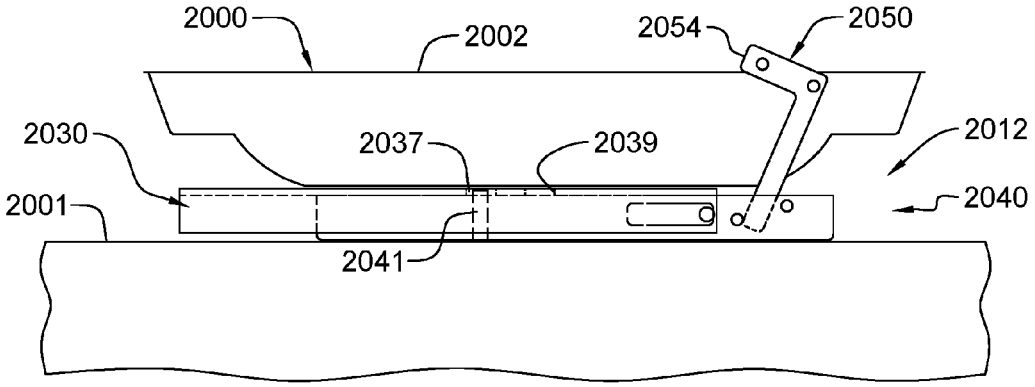
FIG. 13 is a cross-sectional view of the lockable manhole cover of FIG. 11 disposed on the ground such as a sidewalk or a street.
Figure 14:
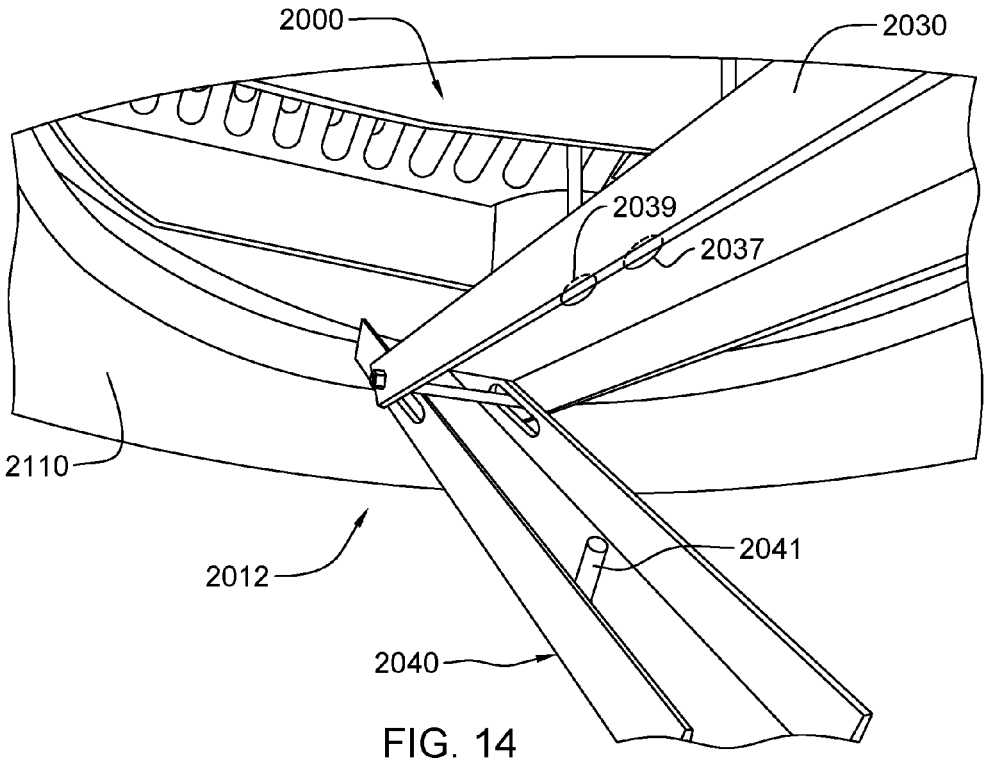
FIG. 14 is a perspective view of the lockable manhole cover of FIG. 12 illustrating the locking assembly disposed in an unlocked position with the manhole frame.

In this embodiment, locking member 2040 includes a restrainer or a pin 2041 engageable or receivable in an aperture 2037 (best shown in FIG. 14) or an aperture 2039 (best shown in FIG. 14) in the web of fixed member 2030 as explained below. The two aperture spacing is such that an upper end portion of pin 2041 may be receivable in aperture 2039 when locking member 2040 is disposed in the locked and horizontal position in manhole frame 2110 (FIG. 11), and may be receivable in aperture 2037 when locking member 2040 is disposed in an unlocked and horizontal position when lockable manhole cover 2000 is disposed on a street or sidewalk 2001 (FIG. 13). Aperture 2037 may be a hole having a diameter J (FIG. 11) of about ¾ inch to about ⅞ inch, and aperture 2039 may be a hole having a diameter K (FIG. 11) of about ¾ inch to about ⅞ inch. Pin 2041 may have a diameter of about ½ inch. The upper end of the pin may be rounded or have tapered or chamfered edges.

As shown in FIG. 11, pin 2041 may be restrained in aperture 2039 to inhibit or form a lock for preventing axial movement of locking member 2040 while in the locked position in manhole frame 2110. Pin 2041 may be restrained in aperture 2039 to lock and inhibit or prevent axial movement of locking member 2040 in the first lockable position. For example, pin 2041 may contact the left most edge of aperture 2039 inhibiting or preventing locking member 2040 from axial movement in the first lockable position.

As shown in FIG. 13, pin 2041 may be restrained in aperture 2037 inhibiting or preventing axial movement of locking member 2040 relative to manhole cover 2002 while in a horizontal position as would be the case when lockable manhole cover 2000 is disposed on street or sidewalk 2001. Also, a leg 2054 of a lever 2050 remains disposed in an upward orientation or position. Locking of locking member 2040 in this case on a street or sidewalk aids in inhibiting or preventing locking member 2040 from moving into the locked position as lockable manhole cover 2000 is being slid into a manhole frame.

Figure 15:
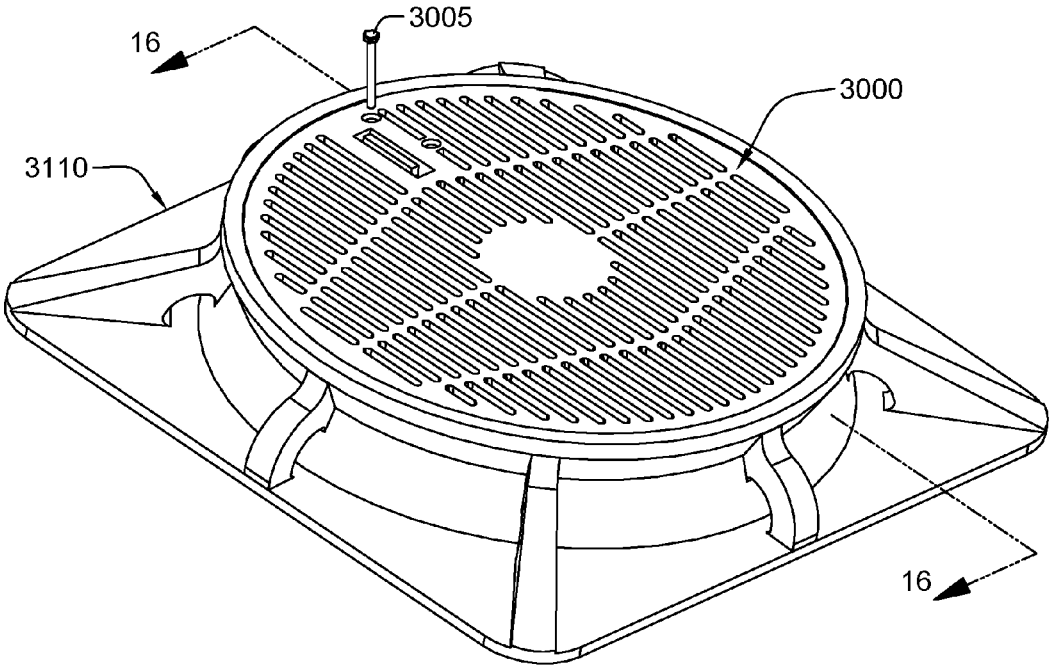
FIG. 15 is a perspective view of a lockable manhole cover and a manhole frame according to an embodiment of the present disclosure.
Figure 16:
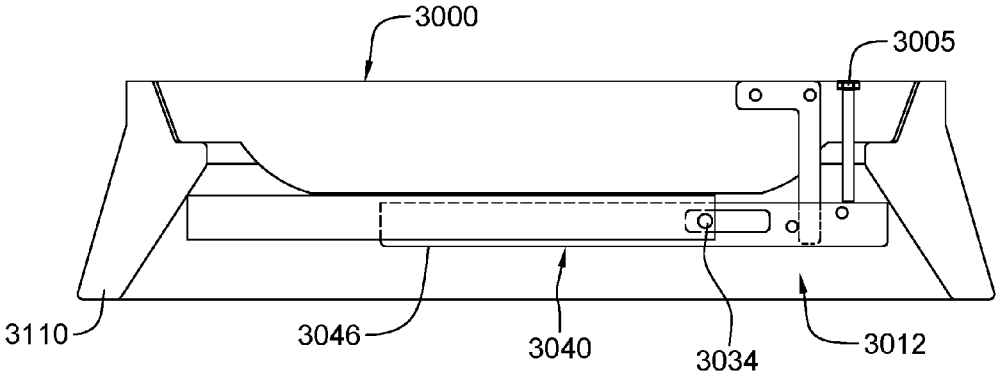
FIG. 16 is a cross-sectional view taken along line 16-16 in FIG. 15 illustrating the locking assembly disposed in a locked position with the manhole frame.

FIGS. 15 and 16 illustrate a lockable manhole cover 3000 according to an embodiment of the present disclosure which may be operable to secure a manhole cover 3000 against unauthorized entry to a manhole frame 3110. Exemplary lockable manhole cover 3000 may be similar to manhole cover 1000 (FIG. 1) as described above with the exception of providing additional protection in maintaining lockable manhole cover 3000 in a locked position or orientation in manhole frame 3110. For example, as long as locking member 3040 (FIG. 16) of locking assembly 3012 (FIG. 16) remains in a locked horizontal position, lockable manhole cover 3000 cannot be removed. In one embodiment, prevention of movement of locking member 3040 (FIG. 16) may be by inhibiting or preventing axial and rotational movement of locking member 3040 (FIG. 14) about a pin 3034 (FIG. 16).

For example, an insert or bolt 3005 such as a tamper resistant bolt may be inserted in a hole that is tapped (e.g., to provide threads) and counter-bored in manhole cover 3000. Authorized personnel may insert bolt 3005 using a special tool designed specifically to engage the head of the bolt. The same tool may be used to remove the bolt. When inserted into manhole cover 3000, the lower end of bolt 3005 may bear against a portion of locking member 3040 as shown in FIG. 16, such as a web portion or a leg portion of a locking member, to more permanently inhibit or prevent axial and rotational movement of locking member 3040.

In another embodiment, a one way pin may be driven into a blank hole previously drilled in the manhole cover. The one way feature is a series of serrations or scales similar to that found on a common metal file. The scales face opposite the direction of insertion such that the pin can be easily driven in only one direction. Removal of the pin requires significant machining effort or drilling out of the pin, so that this approach may be desirable in certain situations requiring high security.

In another embodiment, a pin may be a headless pin made of a relatively soft material such as plastic or fiberglass composite that is driven into a previously drilled hole in the manhole cover. Such a pin may fit in the hole tightly, e.g., sized for an interference fit. Consequently, once driven into the hole, the pin may only be removed by machining it away, e.g., drilling it out. The pin could be brightly colored enabling security personnel to confirm at a glance that the manhole cover is secure.

In further embodiments, such as in a grated manhole cover, a bar of rectangular cross-section may be sized for tight fit in a grate opening. Similar to the soft pin described above, the bar length would be such that when driven flush with the top surface of the cover, a lower end of the bar may engage and prevent axial and rotational movement of a locking member.

Figure 17:
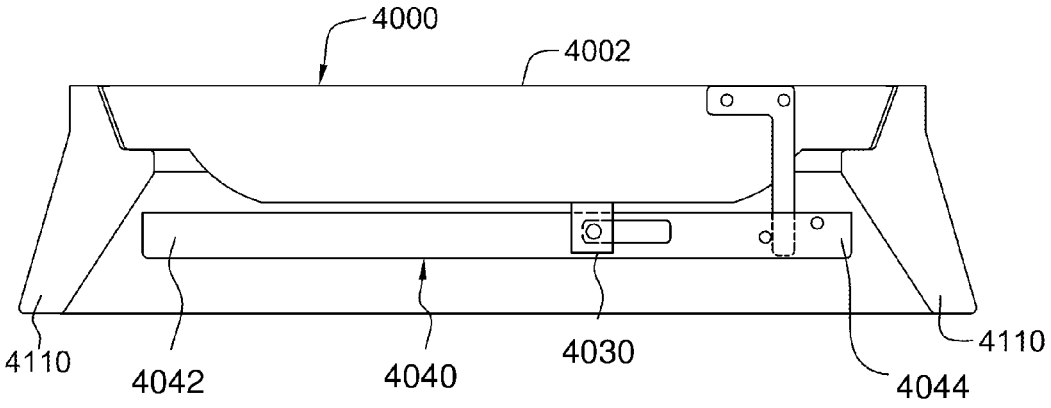
FIGS. 17 and 18 are cross-sectional views of a lockable manhole cover and a manhole frame according to an embodiment of the present disclosure.
Figure 18:
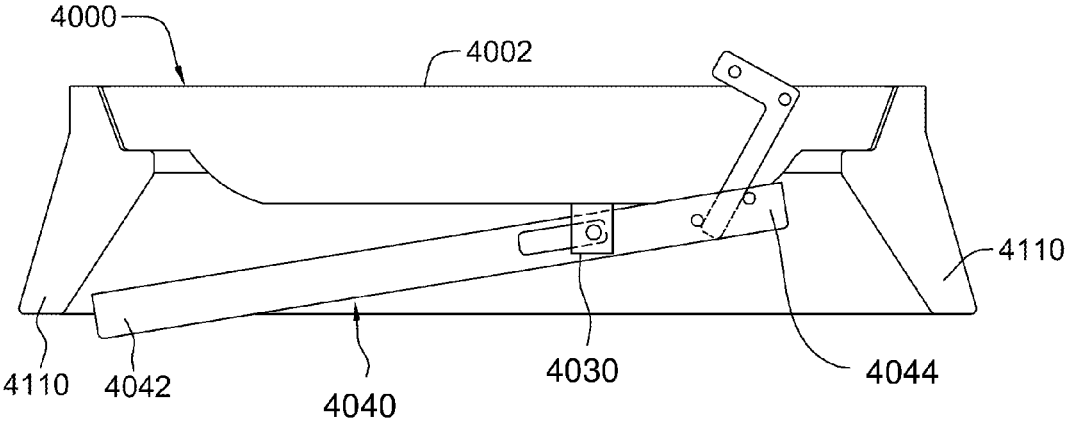

FIGS. 17 and 18 illustrate a lockable manhole cover 4000 according to an embodiment of the present disclosure which lockable manhole cover 4000 is releasably lockable to a manhole frame 4110. Exemplary lockable manhole cover 4000 may be similar to manhole cover 1000 (FIG. 1) as described above with the exception of a locking member 4040 being longer and fixed member 4030 being shorter. In this illustrated embodiment, end portions 4042 and 4044 of locking member 4040 are operably engageable in a first position or orientation with manhole frame 4110 as shown in FIG. 17. Positioning fixed member 1030 towards the middle of manhole cover 4002 aids in balancing the weight of the locking member 4040 making it easier for utility personnel to reposition the lockable manhole cover in a locked and an unlocked position or orientation.

Figure 19:
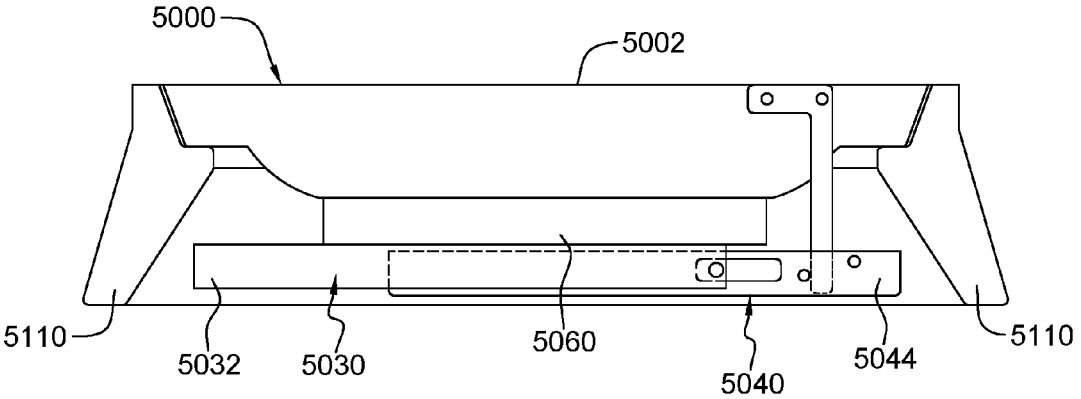
FIGS. 19 and 20 are cross-sectional views of a lockable manhole cover and a manhole frame according to an embodiment of the present disclosure.
Figure 20:
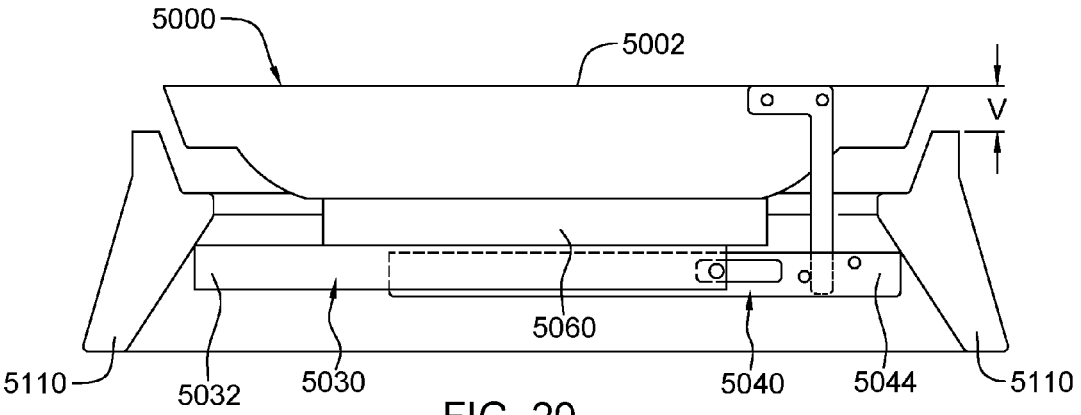

FIGS. 19 and 20 illustrate a lockable manhole cover 5000 according to an embodiment of the present disclosure which lockable manhole cover 5000 is releasably lockable to a manhole frame 5110. Exemplary lockable manhole cover 5000 may be similar to manhole cover 1000 (FIG. 1) as described above with the exception of a locking member 5040 and a fixed member 5030 being spaced below a manhole cover 5002. One or more spacers 5060 may be provided to support fixed member 5030 and locking member

5040 spaced from manhole cover 5002 so that an end portion 5032 of fixed member 5030 and an end portion 5044 of locking member 5040 will engage manhole frame 5110 if manhole cover 5002 is raised more than a certain vertical distance V as best shown in FIG. 20. Such a configuration of lockable manhole cover 5000 is operable to provide a gap between a peripheral-extending edge of manhole cover 5002 and manhole frame 5110 while inhibiting removal of the manhole cover from the manhole frame. This feature provides an outlet for explosive energy that might otherwise fracture the manhole cover resulting in projectiles due to an explosion underneath the manhole cover.

It will be appreciated that lockable manhole covers 1000 (FIG. 1), 2000 (FIG. 11), 3000 (FIG. 15), 4000 (FIG. 17), and 5000 (FIG. 19) may include a bolt, one way pin, headless pin, bar, or other suitable element for securing manhole covers 1000 (FIG. 1), 2000 (FIG. 11), 3000 (FIG. 15), 4000 (FIG. 17), and 5000 (FIG. 19) against unauthorized entry to a manhole frame as described above. From the present description it will be appreciated the lockable manhole covers of the present disclosure may be secured against unauthorized entry to a manhole frame in other suitable ways. For example, the configuration of the locking assembly may allow for fixedly securing the lever to the manhole cover so that the locking member remains in a horizontal locking position or orientation, e.g., the upper leg of the lever may be welded or otherwise secured in the lowered orientation to the manhole cover.

In other embodiments, such as in manhole covers 1000 (FIG. 1), 2000 (FIG. 11), 3000 (FIG. 15), 4000 (FIG. 17), and 5000 (FIG. 19), suitable detents or frictional engaging portions may be employed for maintaining the locking member in a position or orientation that maintains the locking member in a horizontal orientation engageable with the manhole frame to maintain the lockable manhole covers in place in the event of an explosion underneath. For example, the force of an explosion itself underneath the locking member may prevent axial and rotational movement of the locking member relative to the manhole cover thereby maintaining the lockable manhole cover secured to the manhole frame during the explosion.

From the above description, it will be appreciated that in the above embodiments, the positioning and location of slot and pin may be revised. For example, in some embodiments, the pin may be attached to the locking member, and one or more slots may be formed in the fixed member. In addition, from the above description, it will be also appreciated that in the above embodiments, the lever may have other suitable configurations. For example, a lever may have be straight, curved, or have other suitable configurations. Further, from the above description, it will be also appreciated that in the above embodiments, the lever and/or the locking member may be suitably weighted so that the locking member normally remains in the locking position or orientation.

Figure 21:
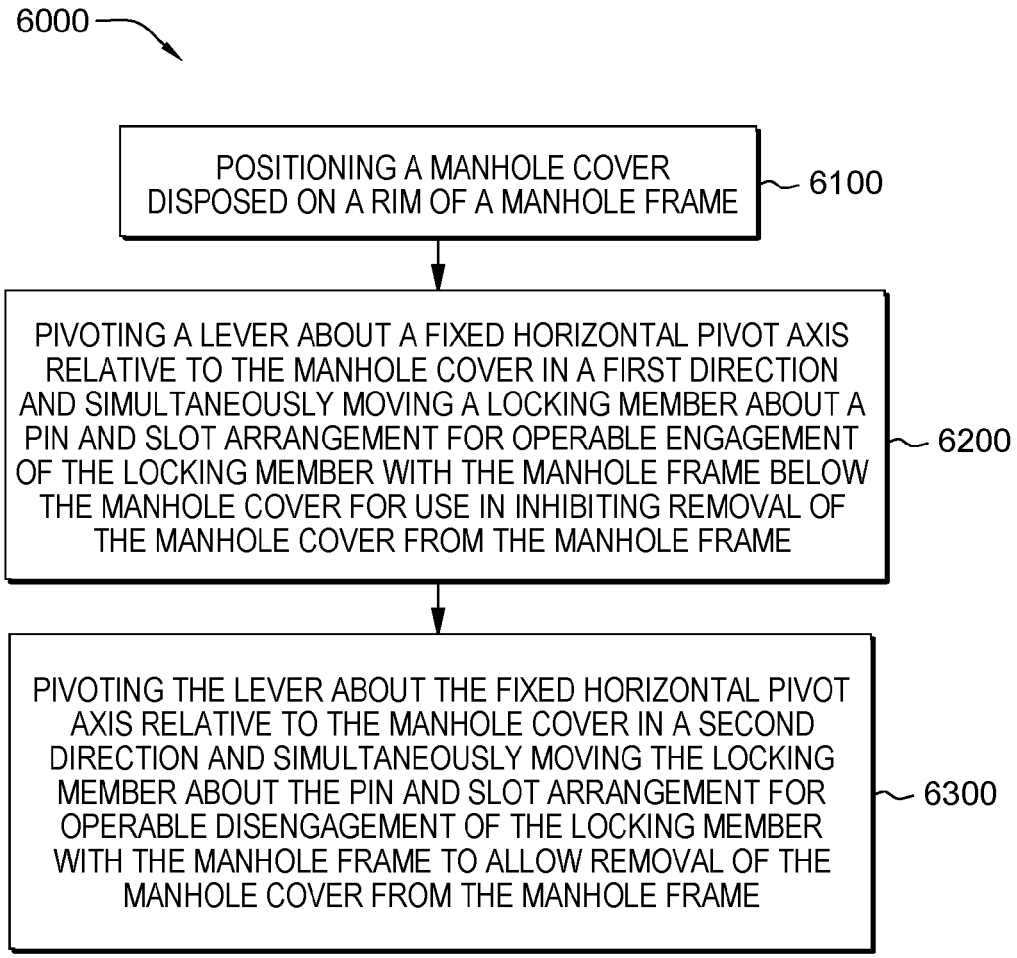
FIG. 21 is a flowchart of a method according to the present disclosure.

FIG. 21 illustrates a method 6000 according to an embodiment of the present disclosure. For example, method 6000 may include at 6100 positioning a manhole cover disposed on a rim of a manhole frame, at 6200 pivoting a lever about a fixed horizontal pivot axis relative to the manhole cover in a first direction and simultaneously moving a locking member about a pin and slot arrangement for operable engagement of the locking member with the manhole frame for use in inhibiting removal of the manhole cover from the manhole frame, and at 6300 pivoting the lever about the fixed horizontal pivot axis relative to the manhole cover in a second direction and simultaneously moving the locking member about the pin and slot arrangement for operable disengagement of the locking member with the manhole frame to allow removal of the manhole cover from the manhole frame.

The technique of the present disclosure provides a lockable manhole cover and methods for locking a manhole cover that may be simple, rugged, retrofittable, provides an obvious indication of engagement, and allow explosion products to escape. Some currently available devices require that the embedded frame be replaced as well as the cover, making the transition very expensive and time consuming. Other approaches are complicated and prone to failure or seizing.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A lockable manhole cover for use with a manhole frame, said lockable manhole cover comprising:

a manhole cover installable in an opening in the manhole frame;

a locking member attached via a pin and slot arrangement beneath said manhole cover;

a lever pivotally attached to said manhole cover, said lever having an upper end portion and a lower end portion, said lower end portion operably engageable with said locking member to move said locking member relative to said manhole cover;

wherein said lever being disposable in a lowered position relative to said manhole cover so that an end portion of said locking member is operably engageable with a portion of the manhole frame below said manhole cover for use in inhibiting removal of said lockable manhole cover from the manhole frame;

wherein said lever being disposable in a raised position relative to said manhole cover so that said end portion of said locking member is operably disengageable with the portion of the manhole frame below said manhole cover to allow removal of said lockable manhole cover from the manhole frame or installation of said lockable manhole cover in the manhole frame; and wherein said locking member comprises an elongated locking member disposable horizontally for use in inhibiting removal of said lockable manhole cover from the manhole frame, and disposable on an angle relative to horizontal to allow removal of said lockable manhole cover from the manhole frame or installation of said lockable manhole cover in the manhole frame.

2. The lockable manhole cover of claim 1 wherein said lockable manhole cover with said lever in said lowered position is operable to provide a gap between a peripheral-extending edge of said manhole cover and the manhole frame while inhibiting removal of said lockable manhole cover from the manhole frame.

3. The lockable manhole cover of claim 1 further comprising a restrainer for limiting horizontal movement of said locking member when said locking member is disposed horizontally.

4. The lockable manhole cover of claim 1 further comprising a restrainer disposable in a first position for limiting horizontal movement of said locking member when said locking member is disposed horizontally and operably engageable with a portion of the manhole cover, and disposable in a second position for limiting longitudinal movement of said locking member when said locking member is disposed horizontally and supported on the ground and said lever disposed in said raised position.

5. The lockable manhole cover of claim 1 wherein said locking member is slidable on the manhole frame as said lockable manhole cover is removable from the manhole frame.

6. The lockable manhole cover of claim 5 wherein said locking member comprises a longitudinal length greater than about 50-percent of a diameter of said manhole cover.

7. The lockable manhole cover of claim 1 wherein said lever comprises an L-shaped lever having a first leg comprising said upper end portion and a second leg comprising said lower end portion, and intersection of said first leg with said second leg being pivotally attached to a lever pin.

8. The lockable manhole cover of claim 7 wherein said first leg of said L-shaped lever being disposable horizontally relative to said manhole cover, and said second leg of said L-shaped lever being disposable downwardly relative to said manhole cover.

9. The lockable manhole cover of claim 7 wherein said upper end portion of said first leg of said L-shaped lever having an aperture for receiving a tool for use in pivoting said L-shaped lever to said raised position.

10. The lockable manhole cover of claim 1 wherein said locking member having a first stop and a second stop, and said lower end portion of said lever being disposable between said first stop and said second stop and engageable therewith to move said locking member into operable engagement with and operable disengagement with the manhole frame.

11. The lockable manhole cover of claim 10 wherein a distance between said first stop and said second stop being greater than a distance across said lower end portion of said lever.

12. The lockable manhole cover of claim 1 wherein said locking member comprises a slot, and said locking member being movable into operable engagement with and operable disengagement with the manhole frame as said slot slides along a pin of said pin and slot arrangement with said pin fixedly attached to said manhole cover.

13. The lockable manhole cover of claim 1 wherein said locking member comprises a C-shaped channel.

14. The lockable manhole cover of claim 13 wherein said C-shaped channel comprises upwardly extending legs having aligned slots, and said locking member being movable as said slots slide along a pin of said pin and slot arrangement with said pin fixedly attached to said manhole cover.

15. The lockable manhole cover of claim 1 further comprising a second member operably fixedly attached to said manhole cover, said locking member movably attached to said second member via said pin and slot arrangement.

16. The lockable manhole cover of claim 15 wherein said lever being disposable in said lowered position relative to said manhole cover so that a second end of said second member is operably engageable with a second portion of the manhole frame below said manhole cover to inhibit removal of the manhole cover from the manhole frame.

17. The lockable manhole cover of claim 15 wherein said locking member comprises a slot, and said locking member being movable into operable engagement with and operable disengagement with the manhole frame as said slot slides along a pin of said pin and slot arrangement with said pin fixedly attached to said second member.

18. The lockable manhole cover of claim 15 wherein said locking member comprises a C-shaped channel, and said second member comprises a C-shaped channel.

19. The lockable manhole cover of claim 18 wherein said C-shaped locking member being slidable on the manhole frame as said lockable manhole cover is removable from the manhole frame.

20. The lockable manhole cover of claim 19 wherein one of said C-shaped locking member and said C-shaped second member being receivable within the other of said C-shaped locking member and said C-shaped second member.

21. The lockable manhole cover of claim 1 further comprising an insert extendable through said manhole cover, a lower end of said insert engageable with said locking member so that said locking member is inhibited from operable disengagement from the manhole frame.

22. The lockable manhole cover of claim 1 further comprising the manhole frame.

23. A method comprising:

providing the lockable manhole cover of claim 1 with the lever in the raised position;

positioning the lockable manhole cover on a rim of the manhole frame; and moving the lever to the lowered position.

24. The method of claim 23 wherein the moving comprises simultaneously moving a lever and the locking member.

25. A lockable manhole cover for use with a manhole frame, said lockable manhole cover comprising:

a manhole cover installable in an opening in the manhole frame;

a locking member attached via a pin and slot arrangement beneath said manhole cover;

a lever pivotally attached to said manhole cover, said lever having an upper end portion and a lower end portion, said lower end portion operably engageable with said locking member to move said locking member relative to said manhole cover;

wherein said lever being disposable in a lowered position relative to said manhole cover so that an end portion of said locking member is operably engageable with a portion of the manhole frame below said manhole cover for use in inhibiting removal of said lockable manhole cover from the manhole frame;

wherein said lever being disposable in a raised position relative to said manhole cover so that said end portion of said locking member is operably disengageable with the portion of the manhole frame below said manhole cover to allow removal of said lockable manhole cover from the manhole frame or installation of said lockable manhole cover in the manhole frame; and wherein said locking member having a first stop and a second stop, and said lower end portion of said lever being disposable between said first stop and said second stop and engageable therewith to move said locking member into operable engagement with and operable disengagement with the manhole frame.

26. The lockable manhole cover of claim 25 wherein a distance between said first stop and said second stop being greater than a distance across said lower end portion of said lever.

27. The lockable manhole cover of claim 25 wherein said lockable manhole cover with said lever in said lowered position is operable to provide a gap between a peripheral-extending edge of said manhole cover and the manhole frame while inhibiting removal of said lockable manhole cover from the manhole frame.

28. The lockable manhole cover of claim 25 further comprising a second member operably fixedly attached to said manhole cover, said locking member movably attached to said second member via said pin and slot arrangement, and wherein said lever being disposable in said lowered position relative to said manhole cover so that a second end of said second member is operably engageable with a second portion of the manhole frame below said manhole cover to inhibit removal of the manhole cover from the manhole frame.

29. The lockable manhole cover of claim 25 further comprising an insert extendable through said manhole cover, a lower end of said insert engageable with said locking member so that said locking member is inhibited from operable disengagement from the manhole frame.

30. The lockable manhole cover of claim 25 further comprising the manhole frame.

31. A method comprising:

providing the lockable manhole cover of claim 25 with the lever in the raised position;

positioning the manhole cover on a rim of the manhole frame; and moving the lever to the lowered position.

32. The method of claim 31 wherein the moving comprises simultaneously moving a lever and the locking member.

33. A lockable manhole cover for use with a manhole frame, said lockable manhole cover comprising:

a manhole cover installable in an opening in the manhole frame;

a locking member attached via a pin and slot arrangement beneath said manhole cover;

a lever pivotally attached to said manhole cover, said lever having an upper end portion and a lower end portion, said lower end portion operably engageable with said locking member to move said locking member relative to said manhole cover;

wherein said lever being disposable in a lowered position relative to said manhole cover so that an end portion of said locking member is operably engageable with a portion of the manhole frame below said manhole cover for use in inhibiting removal of said lockable manhole cover from the manhole frame;

wherein said lever being disposable in a raised position relative to said manhole cover so that said end portion of said locking member is operably disengageable with the portion of the manhole frame below said manhole cover to allow removal of said lockable manhole cover from the manhole frame or installation of said lockable manhole cover in the manhole frame;

a second member operably fixedly attached to said manhole cover, said locking member movably attached to said second member via said pin and slot arrangement; and wherein said lever being disposable in said lowered position relative to said manhole cover so that a second end of said second member is operably engageable with a second portion of the manhole frame below said manhole cover to inhibit removal of the manhole cover from the manhole frame.

34. The lockable manhole cover of claim 33 wherein said locking member comprises a slot, and said locking member being movable into operable engagement with and operable disengagement with the manhole frame as said slot slides along a pin of said pin and slot arrangement with said pin fixedly attached to said second member.

35. The lockable manhole cover of claim 33 wherein said locking member comprises a C-shaped channel, and said second member comprises a C-shaped channel.

36. The lockable manhole cover of claim 35 wherein said C-shaped locking member being slidable on the manhole frame as said lockable manhole cover is removable from the manhole frame.

37. The lockable manhole cover of claim 36 wherein one of said C-shaped locking member and said C-shaped second member being receivable within the other of said C-shaped locking member and said C-shaped second member.

38. The lockable manhole cover of claim 33 wherein said lockable manhole cover with said lever in said lowered position is operable to provide a gap between a peripheral-extending edge of said manhole cover and the manhole frame while inhibiting removal of said lockable manhole cover from the manhole frame.

39. The lockable manhole cover of claim 33 further comprising an insert extendable through said manhole cover, a lower end of said insert engageable with said locking member so that said locking member is inhibited from operable disengagement from the manhole frame.

40. The lockable manhole cover of claim 33 further comprising the manhole frame.

41. A method comprising:

providing the lockable manhole cover of claim 33 with the lever in the raised position;

positioning the manhole cover on a rim of the manhole frame; and moving the lever to the lowered position.

42. A lockable manhole cover for use with a manhole frame, said lockable manhole cover comprising:

a manhole cover installable in an opening in the manhole frame;

a locking member attached via a pin and slot arrangement beneath said manhole cover;

a lever pivotally attached to said manhole cover, said lever having an upper end portion and a lower end portion, said lower end portion operably engageable with said locking member to move said locking member relative to said manhole cover;

wherein said lever being disposable in a lowered position relative to said manhole cover so that an end portion of said locking member is operably engageable with a portion of the manhole frame below said manhole cover for use in inhibiting removal of said lockable manhole cover from the manhole frame;

wherein said lever being disposable in a raised position relative to said manhole cover so that said end portion of said locking member is operably disengageable with the portion of the manhole frame below said manhole cover to allow removal of said lockable manhole cover from the manhole frame or installation of said lockable manhole cover in the manhole frame; and an insert extendable through said manhole cover, a lower end of said insert engageable with said locking member so that said locking member is inhibited from operable disengagement from the manhole frame.

43. The lockable manhole cover of claim 42 wherein said lockable manhole cover with said lever in said lowered position is operable to provide a gap between a peripheral-extending edge of said manhole cover and the manhole frame while inhibiting removal of said lockable manhole cover from the manhole frame.

44. The lockable manhole cover of claim 42 further comprising the manhole frame.

45. A method comprising:

providing the lockable manhole cover of claim 42 with the lever in the raised position;

positioning the manhole cover on a rim of the manhole frame; and moving the lever to the lowered position.

* * * * *